US005336851A

United States Patent [19]

Sawada et al.

[11] Patent Number: 5,336,851

[45] Date of Patent: Aug. 9, 1994

[54] INSULATED ELECTRICAL CONDUCTOR WIRE HAVING A HIGH OPERATING TEMPERATURE

[75] Inventors: Kazuo Sawada; Shinji Inazawa; Kouichi Yamada, all of Osaka, Japan

[73] Assignee: Sumitomo Electric Industries, Ltd., Osaka, Japan

[21] Appl. No.: 989,064

[22] Filed: Dec. 11, 1992

Related U.S. Application Data

[63] Continuation-in-part of Ser. No. 743,428, Aug. 22, 1991, abandoned.

[30] Foreign Application Priority Data

Dec. 27, 1989 [JP] Japan ..... 1-343489

[51] Int. Cl.[5] ..... H01B 7/00

[52] U.S. Cl. ..... 174/110 A; 174/110 PM; 174/120 R; 428/372; 428/384

[58] Field of Search ..... 174/110 R, 110 A, 110 PM, 174/120 R; 428/372, 384

[56] References Cited

U.S. PATENT DOCUMENTS

| | | | |
|---|---|---|---|
| 2,092,636 | 9/1937 | Brossman | 174/110 A |
| 2,097,298 | 10/1937 | Meyers, Jr. | 148/282 |
| 2,105,166 | 1/1938 | Schwarzkopf . | |
| 2,950,993 | 8/1960 | Umbreit | 428/384 |
| 2,975,078 | 3/1961 | Rayfield . | |
| 3,222,219 | 12/1965 | Saunders et al. | 174/120 R |
| 3,325,590 | 6/1967 | Westervelt et al. | 174/120 R |
| 3,691,421 | 9/1972 | Decker et al. | 428/384 X |
| 4,620,086 | 10/1986 | Ades et al. | 174/110 A |
| 5,091,604 | 2/1992 | Sawada et al. | 174/110 A |
| 5,139,820 | 8/1992 | Sawada et al. | 174/110 A |
| 5,212,013 | 5/1993 | Gupta et al. | 428/381 |

FOREIGN PATENT DOCUMENTS 0292780 11/1988 European Pat. Off. .

*Primary Examiner*—Morris H. Nimmo

*Attorney, Agent, or Firm*—W. G. Fasse; W. F. Fasse

[57] ABSTRACT

An insulated wire has a conductor, a first insulating metal oxide layer which is formed around the conductor, and a second insulating metal oxide layer, containing ceramic particles mixed by addition and formed around the first insulating metal oxide layer. The so formed insulating metal oxide layers are produced by changing a precursor of a metal oxide into the ceramic state. This change is caused by a method such as a sol-gel method or a thermal decomposition method. The mixed ceramic particles are more preferably in the form of fine platelets. This insulated wire has an excellent flexibility, emits no gas, can maintain its insulation even at a high temperature, and has a high breakdown voltage.

15 Claims, 1 Drawing Sheet

INSULATED ELECTRICAL CONDUCTOR WIRE HAVING A HIGH OPERATING TEMPERATURE

CROSS-REFERENCE TO RELATED APPLICATION

This application is a continuation-in-part application of copending application U.S. Ser. No. 07/743,428, filed on Aug. 22, 1991, now abandoned.

FIELD OF THE INVENTION

The present invention relates to an insulated electrical conductor wire, and more particularly, it relates to an insulated wire which is substantially fireproof under temperatures up to the melting point of its conductor core. Such a wire can be used in a high temperature or a high vacuum environment.

BACKGROUND INFORMATION

In general, an insulated electrical conductor wire, the conductor of which is coated with heat resistant organic resin such as polyimide, fluororesin or the like, has been employed in equipment such as heating equipment or a fire alarm, for which a safe operation at a high temperature is required. Such wires are also used in the environment of an automobile, particularly in its engine compartment, which is heated to a high temperature, particularly when these wires come into contact with the engine.

Further, an insulated wire, the conductor core of which is passed through a ceramic insulator tube, or an MI cable (Mineral Insulated Cable) having a conductor passing through a heat resistant alloy tube of a stainless steel alloy filled with metal oxide particulates of magnesium oxide or the like, has been employed in a case for which a particularly high heat resistance is required or in an environment for which a high degree of vacuum is required.

On the other hand, a fiberglass braided insulated wire employing a fabric of glass fibers as an insulating member or the like, can be mentioned as an insulated wire having a desirable flexibility, and which can be used in a high-temperature environment. As an insulated wire which has an excellent heat resistance, electrical insulation and ability to dissipate heat there exists the so-called alumire wire, which is produced by anodizing a wire of an aluminum alloy.

It has also been proposed to produce an insulated wire by employing a material such as a metal alkoxide or a metal organic acid salt, that is changeable into a ceramic state by heating for forming a ceramic film around a conductor.

In the aforementioned insulated wire with a conductor core coated with a heat resistant organic resin, the temperature under which the insulation can be maintained, is about 300° C. at the most. Therefore, it has been impossible to use such an insulated wire where a good insulation is required even at a higher temperature.

On the other hand, the aforementioned insulated wire with a conductor passing through a ceramic insulator tube, has a disavantage in that it has an inferior flexibility although its insulation can be maintained at a high temperature. Further, although the aforementioned MI cable can maintain its insulation at a high temperature and is flexible as compared with the aforementioned wire with a conductor passing through a ceramic insulator tube, it is difficult to bend such an MI cable even with large curvature, not to mention a small bending curve.

Further, the aforementioned fiber-glass braided insulated wire can maintain its insulation even at a high temperature and it has an excellent flexibility. However, it has been impossible to use this wire in an environment for which a high degree of vacuum must be maintained, since the fiberglass insulation easily discharges dust.

On the other hand, the aforementioned alumite wire can maintain its insulation even at a high temperature, and has some flexibility. However, the use of the alumite wire has been limited since the conductor employed in an alumite wire is restricted to aluminum alone.

As to the aforementioned insulated wire which is made by forming a ceramic layer around a conductor, the ceramic layer is mostly a single layer having a small layer thickness, and it has been difficult to increase the breakdown voltage, although the wire has an excellent flexibility.

U.S. Pat. No. 2,105,166 (Schwarzkopf), Jan. 11, 1938, discloses an electrical heating element with an electrical heating wire of molybdenum, tungsten, or tantalum forming a refractory metal core surrounded by a sintered cover containing an inner portion of metal oxide from groups 2, 3, and 4, except silicon, of the periodic table of elements, in contact with the core and an outer portion in which the metal oxide forms the major proportion and an addition of oxygen containing silicon compound. The inner metal oxide of the cover shall have a melting point higher than 1600° C. and the silicon compound of the outer portion shall have a melting point sufficiently lower than 1600° C. so that all the oxide present is sintered into gas-tight fragments. The sintering takes place at temperatures within the range of about 1400° C. to 2200° C. As a result, the conductor core must have a melting point sufficiently high to withstand these sintering temperatures. Copper and similar electrical conductor metals can thus not be used in the teaching of Schwarzkopf.

U.S. Pat. No. 2,975,078 (Rayfield), Mar. 14, 1961, discloses a method for producing an electrical conductor wire coated with a ceramic for use in a high temperature environment. The core is copper which is first provided with a nickel coating that is heated to form a nickel oxide on the surface of the copper core. Thereafter, a ceramic powder in the form of a so-called "slip" is applied to the nickel oxide surface and the ceramic powder on the wire is heated to produce a fused ceramic coating that is bonded to the copper wire core through the nickel oxide coating. The fusing or sintering takes place at a temperature in the range of 1600° F. to 1800° F. The ceramic coating of Rayfield is of the "vitrious enamel type of ceramic" produced of metallic oxides that form a glass type coating by fusion. The ceramic "slip" for producing the fusion glass comprises among other metal oxides a substantial proportion of lead oxide, namely 20% to 45% to keep the resulting fused glass coating pliant. However, such fused lead glass coatings have a relatively low melting point and the electrical insulation of this fused lead glass decreases significantly at a temperature exceeding 800° C. Besides, such a fused lead glass is relatively coarse grained and hence porous. These features of Rayfield leaves room for improvement.

SUMMARY OF THE INVENTION

It is an object of the present invention to solve the aforementioned problems of conventional insulated electrical conductor wires. More specifically, the invention provides a high temperature resistant electrical conductor wire that is highly flexible, and has a high break-down voltage in the range of 500 V to 50,000 V at operating temperatures in the range of 600° C. to 1,600° C., so that such wires can be used for example, even in contact with operating internal combustion engines.

Another object of the invention is to provide an insulated electrical conductor wire which does not have any gas emission so that the present wire can be used inside of and leading into vacuum devices.

Further, the invention makes it possible to use various types of conductors which themselves do not have exceptionally high melting points such as aluminum, copper, silver, and gold.

It is also an important object of the invention to produce the high temperature resistant insulating coating layers at baking temperatures which are substantially lower than the sinter or fusion temperatures required heretofore by the above mentioned Rayfield and Schwarzkopf disclosures.

The insulated wire according to the present invention comprises an electrical conductor core, a first insulating metal oxide layer which is formed around the conductor, and a second insulating metal oxide layer, containing ceramic particles mixed by addition, which is formed around the first insulating metal oxide layer. More specifically, according to the invention, an insulated electrical conductor wire for use under high temperature operating conditions of at least 600° C., is characterized by a combination of the following features, comprising an electrical conductor core having a clean surface, said electrical conductor core having a first melting point within the range of up to 1500° C., a first electrically insulating ceramic layer having a thickness of 1 to 10 μm bonded to said clean surface of said conductor core, said first electrically insulating ceramic layer having a second melting point higher than said first melting point of said electrical conductor core, and a second electrically insulating ceramic layer bonded to said first electrically insulating ceramic layer, said second electrically insulating ceramic layer comprising a ceramic matrix and ceramic particles uniformly dispersed and embedded in said ceramic matrix, said second ceramic layer having a third melting point also higher than said first melting point of said electrical conductor core.

The first and second electrically insulating ceramic layers are metal oxide layers and are preferably formed by applying a precursor of a metal oxide containing at least one compound which is selected from a group of alkoxides or organic acid salts of Si, Zr, Al and Ti, to the peripheral surface of a conductor core and changing the precursor to a ceramic state by heating, using a method such as a sol-gel method, a thermal decomposition method or the like, whereby it is possible to form the desired layers at a substantially lower baking temperature within the range of about 400° C. to about 600° C., or 1000° C. at the most, compared to substantially higher sintering or fusing temperatures required by the prior art.

Preferably, the insulated wire of the invention is produced by embedding ceramic particles in the ceramic matrix of the second insulating metal oxide ceramic layer in the form of fine platelets, having an average or mean diameter of about 2 μm.

Further, an insulated wire having a superior flexibility is obtained when the layer thickness of the first insulating metal oxide layer is within the range of 1 to 10 μm.

In addition, it is possible to provide the present insulated wire with an external protective coating, by coating the outer surface of the second insulating metal oxide ceramic layer with an insulating material containing an organic material selected from the group including such electrically insulating materials as polyethylene, vinyl chloride, urethane, acrylic resin, polyimide, fluororesin, polyamide imide, and similarly suitable materials.

The conductor is not particularly restricted to exclusive use at high temperatures. The configuration and the materials combined in a particular embodiment may be selected with regard to the intended use of the present conductor wire such as for a thermocouple or as a flexible printed circuit conductor, for example.

Since the insulated wire according to the present invention comprises insulating layers of metal oxides having extremely high melting points around the conductor, it is possible to maintain the insulation even at a temperature higher than a conventional insulated wire which is coated with heat resistant organic resin.

Further, the insulated wire according to the present invention can be used in a high-vacuum environment, since the same does not emit any gas.

In the present invention, the insulating metal oxide layer can be increased in thickness since the ceramic particles are contained in or are embedded in the insulating metal oxide layer by addition, whereby it is possible to obtain an insulated wire having a high breakdown voltage up to 1200 Volts and more.

It is difficult to increase the thickness of the first insulating metal oxide layer, whereby an insulated wire comprising only the first layer, has a low breakdown voltage of about 500 Volts. However, since the first insulating metal oxide layer is in close contact with the conductor core, it has an excellent flexibility and can maintain its insulation even if the same is extremely deformed when it is being bent or the like.

On the other hand, the second insulating metal oxide layer has a high insulability since the same can be easily increased in thickness by applying a substance obtained by adding ceramic particles to a precursor of a ceramic, to the conductor and baking the same. If this layer alone is formed around the conductor, however, it may not be possible to maintain a good insulation due to fine cracks caused in the layer when the same is extremely deformed by bending or the like, since the layer has an inferior adhesion with the conductor and a low bonding of particles within the layer to the first insulating metal oxide layer.

Therefore, the aforementioned first layer is formed around the conductor and the aforementioned second layer is further formed around the first layer, so that fine cracks, that may be caused in the second layer by an extreme deformation resulting from bending or the like, are prevented in the first layer, and it is possible to maintain a high insulability by all insulating layers. It is surprising that the first layer alone would tend to crack while both layers together prevent such cracks.

When alkoxides or organic acid salts of Si, Zr, Al and Ti are employed as materials for the first and/or second insulating metal oxide layer, it is possible to form homogeneous insulating layer(s) by preparing a solution of these oxide precursors and applying the solution to the conductor using a method such as a sol-gel method or a thermal decomposition method. The applied solution coating is then baked at the above mentioned temperatures.

Further, if the ceramic particles which are embedded in the ceramic matrix of the second insulating metal oxide layer by addition prior to the coating application, are in the form of fine platelets, it is possible to obtain an insulated wire having a higher breakdown voltage presumably due to the uniform texture without any pores with a density corresponding to the theoretically possible density of the respective ceramic material.

Further, if the thickness of the first insulating metal oxide layer is 1 to 10 μm an electrically insulated conductor wire having a superior flexibility is obtained.

It is also possible to use the wire as a fireproof wire by providing an outer protective coating containing an organic material on the outer surface of the second insulating metal oxide layer.

DETAILED DESCRIPTION OF PREFERRED EXAMPLE EMBODIMENTS AND OF THE BEST MODE OF THE INVENTION

Example 1

Figure 1:
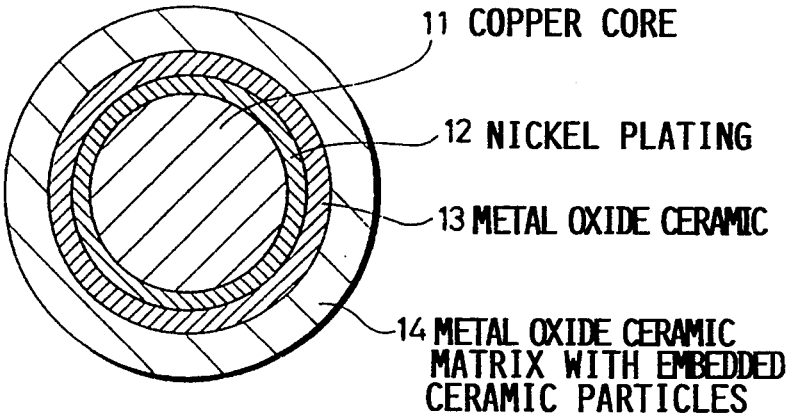
FIG. 1 is a sectional view of an insulated wire according to the present invention, wherein a first insulating silicon oxide layer of 5 μm in thickness and a second insulating metal oxide layer of 35 μm in thickness have been formed around a nickel-plated copper wire of 1 mm in diameter.

A copper wire 11 having a diameter of 1 mm was used as the conductor core. The wire 11 was provided with a nickel plating 12 as shown in FIG. 1.

One mole percent of nitric acid was added to a mixed solution of four mole percent of tetraethoxysilane, twenty-four mole percent of water and seventy-one mole percent of ethyl alcohol to form a solution. This solution was applied to the aforementioned nickel-plated copper wire, and thereafter baking was carried out at a temperature of 500° C. for about six minutes, until a first insulating silicon oxide layer 13 of 5 μm in thickness was formed.

Further, a substance, which was obtained by mixing two parts of mica of about 2 μm in mean particle diameter to ten parts of a mixed solution of four mole percent of tetraethoxysilane, one mole percent of tetraethoxyzirconium, one mole percent of water and ninety-four mole percent of ethyl alcohol as ceramic particles, was applied to the peripheral surface of the aforementioned first insulating silicon oxide layer 13, and thereafter baking was carried out at a temperature of 600° C. for about one minute until a second insulating metal oxide layer 14 of 35 μm in thickness was formed.

When only the first insulating metal oxide layer 13 had been formed, a breakdown voltage of 500 Volts was measured when testing the insulated wire at an operating temperature of 600° C. Further, breakdown voltage of at least 1200 Volts was measured when testing an insulated wire which was provided with the first and the second insulating metal oxide layers 13 and 14 containing ceramic particles as mentioned above. The breakdown voltage of 1200 Volts was measured when testing the double coated wire at a temperature of 600° C.

Thus, it has been shown that an insulated wire having a high breakdown voltage can be obtained according to the present invention.

Even if the insulated wire formed by the aforementioned process was held at a temperature of 850° C. for thirty minutes, the insulation was maintained. Thus, it has been shown that the insulated wire obtained according to the present invention can maintain its insulation even at a high temperature.

Example 2

Figure 2:
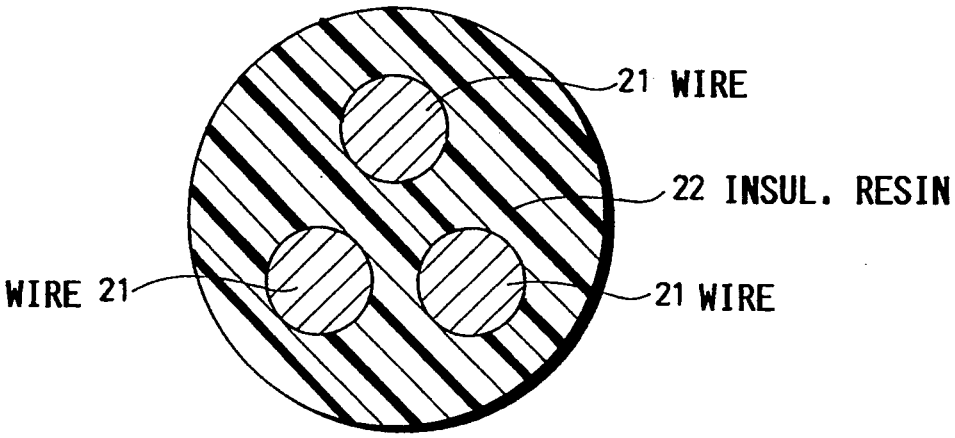
FIG. 2 is a sectional view of an insulated wire which is made by first coating three insulated wires as shown in FIG. 1, and then enclosing the three wires in an organic insulator, such as polyolefin resin mixed with magnesium hydroxide.

Three insulated wires obtained in Example 1 and shown in FIG. 1 were encased or coated with polyolefin resin mixed with magnesium hydroxide, to obtain a cable with three wires as shown in the sectional view of FIG. 2.

Three insulated wires 21 are gathered and respectively coated with polyolefin resin 22 mixed with magnesium hydroxide, to form a triple wire cable.

This cable continuously served at a temperature of 850° C. for thirty minutes.

The conductor core of the invention can now be selected from materials having a substantially lower melting point than was possible in the prior art. Thus, according to the invention the electrical conductor core is preferably selected from aluminum having a melting point of 660° C., silver having a melting point of 961° C., copper having a melting point of 1083° C., or gold with a melting point of 1064° C. Alloys of the foregoing electrical conductor metals are also suitable for the present purposes. The ceramics of the first layer 13 and of the second layer 14 are selected from such oxides as silicon oxide with a melting point of 1700° C., zirconium oxide with a melting point of 2760° C., aluminum oxide with a melting point of 2060° C., and titanium oxide with a melting point of 1640° C.

Thus, the present conductor core has a material with a substantially lower melting point than the two insulating layers. Preferably, the melting point of the insulating layers is about 1.2 times to 1.5 times higher than the melting point of the electrical conductor core. More specifically, the melting points of the insulating layers 13 and 14 are about 500° C. to about 1200° C. higher than the melting point of the electrical conductor core 11.

In a preferred embodiment the melting point of the first layer 13 is higher than the melting point of the conductor core 11 and the melting point of the outer layer 14 is in turn higher than the melting point of the second layer 13. The melting point of the conductor core is about 1200° C. at the most. On the other hand, the melting points of the second and third layers is preferably at least 1600° C.

The layers 13, 14 formed of alkoxide and/or organic acid salts of silicon, zirconium, aluminum, and titanium, are exposed to a baking temperature within the range of about 400° C. to about 1000° C. at the most, whereby the baking time is longer at the lower temperatures. Baking times within the range of six minutes to one minute have been found suitable. The baking temperatures are substantially lower than the fusing and sintering temperatures in the prior art. This feature is a distinct advantage of the present invention.

The above mentioned ceramic particles in the ceramic matrix of the second layer 14 are uniformly dispersed and distributed throughout the matrix material and these particles are preferably fine platelets having a mean or average platelet diameter of 2 μm, for example, in the form of mica platelets.

Preferably, both layers 13 and 14 have a uniform grain size averaging about 2 μm in diameter to form a fine texture of the coating free of pores to prevent the emission of gas from the wire.

Although the invention has been described with reference to specific example embodiments, it will be appreciated that it is intended to cover all modifications and equivalents within the scope of the appended claims.

What we claim is:

1. An insulated electrical conductor wire for use under high temperature operating conditions of at least 600° C., comprising an electrical conductor core having a clean surface, said electrical conductor core having a first melting point within the range of up to 1500° C., a first electrically insulating ceramic layer having a thickness of 1 to 10 μm bonded to said clean surface of said conductor core, said first electrically insulating ceramic layer having a second melting point higher than said first melting point of said electrical conductor core, and a second electrically insulating ceramic layer bonded to said first electrically insulating ceramic layer, said second electrically insulating ceramic layer comprising a ceramic matrix and ceramic particles uniformly dispersed and embedded in said ceramic matrix, said second ceramic layer having a third melting point also higher than said first melting point of said electrical conductor core.

2. The insulated electrical conductor wire of claim 1, wherein a material of said electrical conductor core is selected from the group consisting of aluminum (m.p. 660° C.), silver (m.p. 961° C.), copper (m.p. 1083° C.), gold (m.p. 1064° C.), and alloys of the foregoing, and wherein ceramics of said first and second ceramic layers are selected from the group consisting of oxides of silicon (m.p. 1700° C.), zirconium (m.p. 2760° C.), aluminum (m.p. 2060° C.), and titanium (1640° C.).

3. The insulated electrical conductor wire of claim 1, wherein said first and second ceramic layers have respective melting points within the range of 1.2 to 1.5 times said first melting point of said electrical conductor core.

4. The insulated electrical conductor wire of claim 1, wherein said second and third melting points are higher by about 500° C. to about 1200° C. than said first melting point.

5. The insulated electrical conductor wire of claim 1, wherein said second melting point is higher than said first melting point of said electrical conductor core, and said third melting point is higher than said second melting point.

6. The insulated electrical conductor wire of claim 1, wherein said first melting point of said electrical conductor wire is 1200° C. at the most.

7. The insulated electrical conductor wire of claim 1, wherein said second and third melting points are at least 1600° C.

8. The insulated electrical conductor wire of claim 1, wherein said first and second layers are formed of at least one baked member selected from the group consisting of alkoxides and organic acid salts of Si, Zr, Al, and Ti.

9. The insulated electrical conductor of claim 8, wherein said baked member was exposed to a baking temperature of about 400° C. to about 1000° C. at the most for about six minutes to one minute.

10. The insulated electrical conductor of claim 1, wherein said ceramic particles uniformly dispersed and embedded in said ceramic matrix of said second ceramic layer are fine platelets having a mean or average platelet diameter of about 2 μm.

11. The insulated electrical conductor of claim 10, wherein said platelets are mica platelets.

12. The insulated electrical conductor of claim 1, further comprising an organic material insulating third layer on said second layer, said third layer comprising a member selected from the group consisting of polyethylene, vinyl chloride, polyurethane, acrylic resin, polyimide, fluororesin, and polyamide imide.

13. The insulated electrical conductor wire of claim 1, wherein said wire has a break-down voltage of at least 1200 V at an operating temperature of 600° C.

14. The insulated electrical conductor wire of claim 9, wherein said baking temperature was within the range of 400° C. to 600° C. at the most.

15. The insulated electrical conductor wire of claim 1, wherein said first and second ceramic layers have a uniform grain size averaging about 2 μm in diameter to form a fine textured coating free of pores to prevent the emission of gas from said wire.

* * * * *

UNITED STATES PATENT AND TRADEMARK OFFICE

CERTIFICATE OF CORRECTION

PATENT NO. : 5,336,851

DATED : August 9, 1994

INVENTOR(S) : Kazuo Sawada et al.

It is certified that error appears in the above-identified patent and that said Letters Patent is hereby corrected as shown below:

title page:

Item [30]: --Dec. 26, 1990 [PCT] PCT/JP90/01700--;

Item under [56]: replace "5,091,604" by --5,091,609--.

Signed and Sealed this

Eighth Day of November, 1994

*Attest:*

*Attesting Officer*

BRUCE LEHMAN

*Commissioner of Patents and Trademarks*